US006729095B2

(12) United States Patent
Wang Chen

(10) Patent No.: US 6,729,095 B2
(45) Date of Patent: May 4, 2004

(54) REFINED ASSEMBLY STRUCTURE OF HUBBED DOOR LEAF INSTALLED WITH GLASS

(75) Inventor: Kuei Yung Wang Chen, Taipei (TW)

(73) Assignee: Nan Ya Plastics Corporation, Taipei (TW)

( * ) Notice: Subject to any disclaimer, the term of this patent is extended or adjusted under 35 U.S.C. 154(b) by 0 days.

(21) Appl. No.: 09/853,593

(22) Filed: May 14, 2001

(65) Prior Publication Data

US 2002/0092254 A1 Jul. 18, 2002

(51) Int. Cl.[7] ..... E04B 3/70

(52) U.S. Cl. ..... 52/456; 52/456; 52/455; 52/309.4; 52/784.1; 52/784.15; 49/501

(58) Field of Search ..... 52/456, 455, 309.4, 52/784.1, 784.15, 784.16, 792.1, 792.11; 49/503, 501

(56) References Cited

U.S. PATENT DOCUMENTS 4,327,535 A * 5/1982 Governale ..... 52/208
4,550,540 A 11/1985 Thorn
6,024,908 A * 2/2000 Koncelik ..... 264/331.11
6,161,363 A * 12/2000 Herbst ..... 52/784.15
6,311,454 B1 * 11/2001 Kempel ..... 52/784.15
6,393,779 B1 * 5/2002 Boldt ..... 49/501
6,415,558 B1 * 7/2002 Cherry ..... 52/79.1

* cited by examiner

*Primary Examiner*—Carl D. Friedman
*Assistant Examiner*—Nahid Amiri
(74) *Attorney, Agent, or Firm*—Stevens, Davis, Miller & Mosher, LLP.

(57) ABSTRACT

The present invention relates to a refined assembly structure of hubbed door leaf installed with glass, which comprises a first door skin with an opening, a second door skin with an opening, a top lacing material, a bottom lacing material, a left lacing material, a right lacing material, a handle reinforcement member and the ejected frame with multiplayer glass hold-down. The door skin with opening can be manufactured to be various shapes such as square, rectangular, circle, ellipse, and semicircle depending on different mold. When assembled, the lacing materials are mounted to the edges of the first door skin by the adhesive. The left and the right lacing materials are position-bonded, by ribs, to the flush-sided door skin. The top and the bottom lacing materials are positioned through the milled notches at the top and the bottom ends of the left and the right lacing materials. A reinforcement member is disposed at the handle position to enhance the mechanical strength of the handle while locked. The openings of the two door skins have halving structure to halve-joint together when assembled to form a closed cabin therebetween. The bottom lacing material is then drilled with a hole through which the ammonium polyester foaming plastic is filled into the cabin so as to finish the assembling of the said door.

6 Claims, 7 Drawing Sheets

REFINED ASSEMBLY STRUCTURE OF HUBBED DOOR LEAF INSTALLED WITH GLASS

FIELD OF THE INVENTION

The present invention relates to the field of assembled door structures and manufacturing.

BACKGROUND OF THE INVENTION

In the prior art of door manufacturing, it is very common to cut an opening on the door and install glass to make change of the traditional door to meet various needs of the market. However, problems are introduced in the door manufacturing process to achieve this result:

1. The manufacturing efficiency is affected due to the necessity of increasing the processing of a CNC center and the procedure of installing milling groove lacing materials to the four sides of the opening.
2. The material from cutting the opening is wasted.
3. The prior halving glass assembling structure is not molded in one body, which reduces less watertight and needs to be locked by screws and to be decorated by a screw lid. The assembling process is much more complicated.
4. The prior halving structure door, which comprises two glasses decorating frames, needs to be assembled and painted manually, which affects the efficiency.
5. The glass ejected-frame bulges out of the door skin. Consequently, the prior halving structure is unsuitable for a sliding door.

SUMMARY OF THE INVENTION

In accordance with one aspect of the present invention there is provided an assembly structure of hubbed door installed with glass comprising: two door skins with opening, each door skin having form edges, surrounding lacing material including a top lacing material, a bottom lacing material, a left lacing material, a right lacing material, a handle reinforcement member, and a multi-layer glass ejected-frame; the four edges of each door skin are smooth in order to adhere to the surrounding lacing material when assembled; a reinforcement member laid into a handle position to increase the mechanical strength of the handle when locked; the openings of the two door skins have halving structure to halve-joint together while assembled to form a closed cabin therebetween; and the bottom lacing material having an aperture through which the ammonium polyester foaming plastic is fillable into the cabin.

In an exemplary embodiment an assembly structure of hubbed door installed with glass, wherein one of the openings of the door skin having a halving structure is formed halve-joint together while assembled to form a closed cabin therebetween for laying a single layer or multi-layer glass.

In an exemplary embodiment an assembly structure of hubbed door installed with glass, wherein the opening can be inlaid with a glass ejected-frame to fix a multi-layer glass; wherein the material of the glass ejected-frame is selected from wood, steel, polyvinyl chloride extrude profile, PVC foam profile, PVC plus wood scraps, polystyrene, polypropylene, and polypropylene plus fiber glass; the surface thereof selected from a smooth surface without wood vein and a mimetic wood vein; and the depth of wood vein being between approximately 0.05 to 1.0 mm.

In an exemplary embodiment an assembly structure of hubbed door installed with glass, wherein the material of the door skin are selected from Sheet Molding Compound of reinforced fiber glass, wood fiber, steel and wood; the surface thereof selected from a smooth surface without wood vein and a mimetic wood vein; wherein the depth of wood vein being between approximately 0.05 to 0.2 mm; and wherein the opposite side of the skin are rough to increase the friction when the door is assembled by adhesive.

In an exemplary embodiment an assembly structure of hubbed door installed with glass, wherein the material of the lacing material is selected from polyvinyl chloride extrude profile, PVC foam profile, wood, steel, and ejected plastic.

More specifically to solve the problems of production efficiency, cost, waste disposal existing in the door manufacturing of prior art discussed above, the present invention discloses a refinement of R.O.C. New Model No. 107146 "Improvement of the Assembly Structure of the Hubbed Door". More particularly, the present invention discloses a refinement of the assembly structure of hubbed door installed with glass.

SYMBOL DESCRIPTION OF THE DRAWINGS

Figure 1:
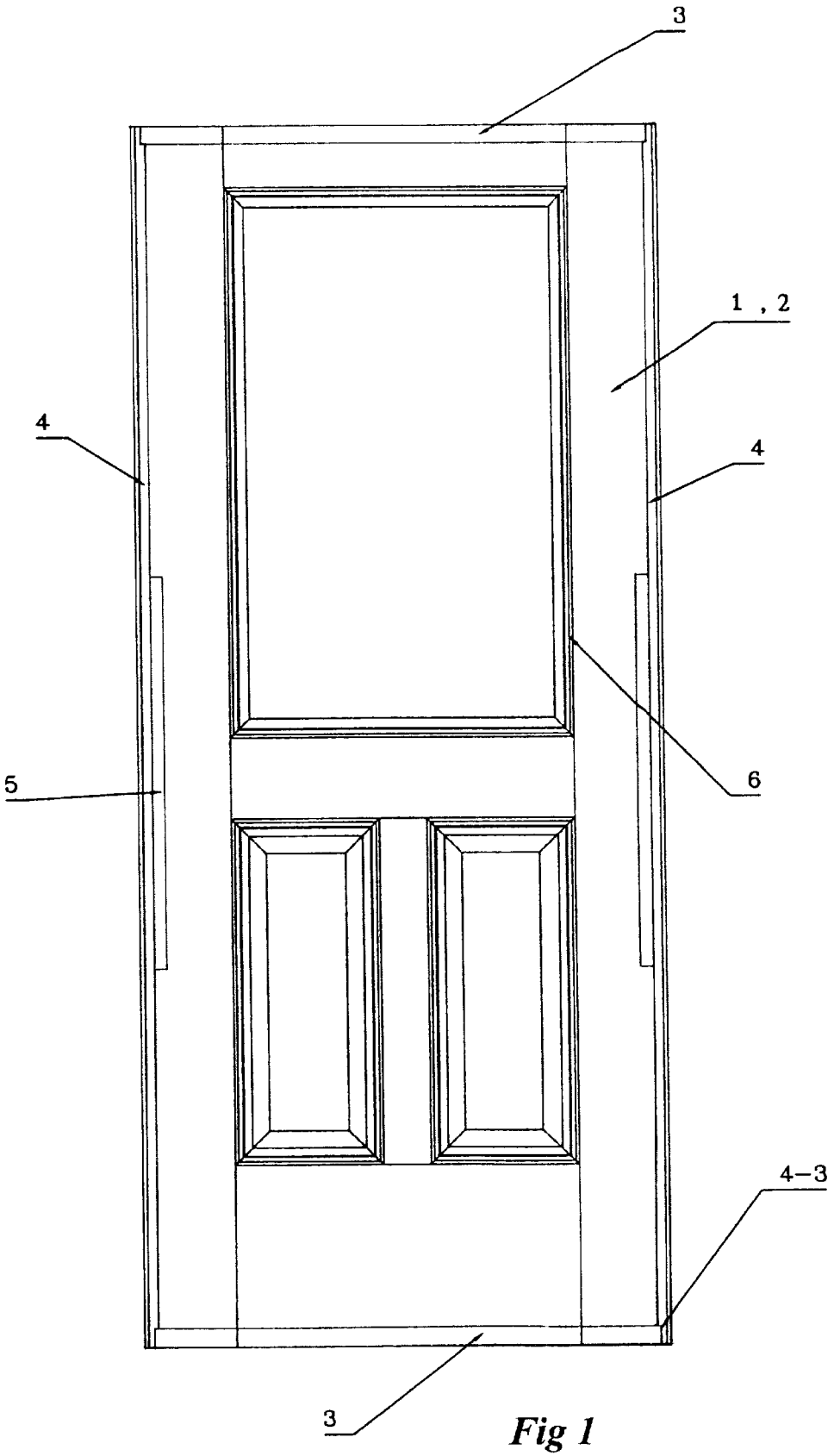
FIG. 1 is an assembly drawing of the door structure of the present invention.

1 and 2: The skin of the hubbed door.
3: The top lacing material and the bottom lacing material.
3-1: The top lacing material.
3-2: The bottom lacing material.
4: The left lacing material and the right lacing material.
4-1: The left lacing material.
4-2: The right lacing material.
4-3: The notch milled at the top end and the bottom end of the left lacing material and the right lacing material.
5: The handle reinforcement member.
6: The glass ejected frame.
7: The U shape structure of the door skin.
8: The L shape structure of the door skin.
9: The rib of the L shape structure.
10: The groove of the U shape structure.
11: The horizontal rib of the U shape structure.
12: The groove injected with silicone.
13: The slope of saw shape.
14: The reinforcement rib.
15: The single layer of multi-layer glass.
16: The reinforcement rib of the glass ejected-frame.
17: The footing post of the glass ejected-frame.
18: The inlay structure of the glass ejected-frame.
19: The milled groove at the end of the lacing material.
20: The milled groove at the end of the bottom lacing material.

21: The ammonium polyester foaming plastic.

DETAILED DESCRIPTION OF THE EMBODIMENTS OF THE PRESENT INVENTION

The present invention discloses an assembly structure of a hubbed door leaf installed with glass, which comprises two door leaf skins 1 and 2 with an opening, a top and a bottom lacing materials 3, a left and a right lacing material 4, a handle reinforcement member 5, and a glass ejected-frame 6.

The said door skin 1 and 2 has a thickness of from about 1 mm to 4 mm; the four edges thereof are designed to be flush surface to be closely adhered to the top, the bottom, the left, and the right lacing materials 3 and 4 and then assembled. The said lacing material can be polyvinyl chloride foam profile, or wood, or steel, or ejected plastic, etc. The four edges of the opening of the door skin 1 are designed to be U shape structure 7, which are formed in one body. The four edges of the opening of the other door skin 2 are L shape structure 8, which are formed in one body. The rib 9 of the structure 8 inlays with the groove 10 of the U shape structure 7 when assembled for positioning purposes. A space of about 0.5 by 2.3 mm is left between the rib 9 and the groove 10 after being assembled in order to prevent the overflow of the adhesive when assembled.

A horizontal rib 11 is provided at the external edge of the U shape structure 7, which is utilized to support the multi-layer glass laid on the opening of the door. A groove 12 is provided at the surface of the rib, which can be spread with adhesive such as silicone before assembling the glass in order to closely bond the door and the glass to increase the watertight and gastight seals. The top of the U shape structure 11 is provided with two saw-shaped slopes 13 which form a horizontal groove with the external edge of L shape structure 8. The horizontal groove is provided to be inserted by the glass hold-down or the glass ejected-frame to fix the single layer or multi-layer glass.

The material of the said single layer or multi-layer glass ejected-frame can be wood, steel, polyvinyl chloride extrude profile, PVC foam profile, PVC plus wood scraps, polystyrene, polypropylene, or polypropylene plus fiber glass.

The material of the door skin 1 and 2 of the present invention can be the Sheet Molding Compound of reinforced fiber glass (referring to R.O.C. Invention patent No. 69423), wood fiber, steel or wood; the surface thereof can be a smooth surface without wood vein or be a mimetic wood vein. The depth of wood vein is about 0.05 to 0.2 mm. The opposite side of the said skin is a rough surface to increase the friction when the door is assembled by the adhesive.

Figure 2:
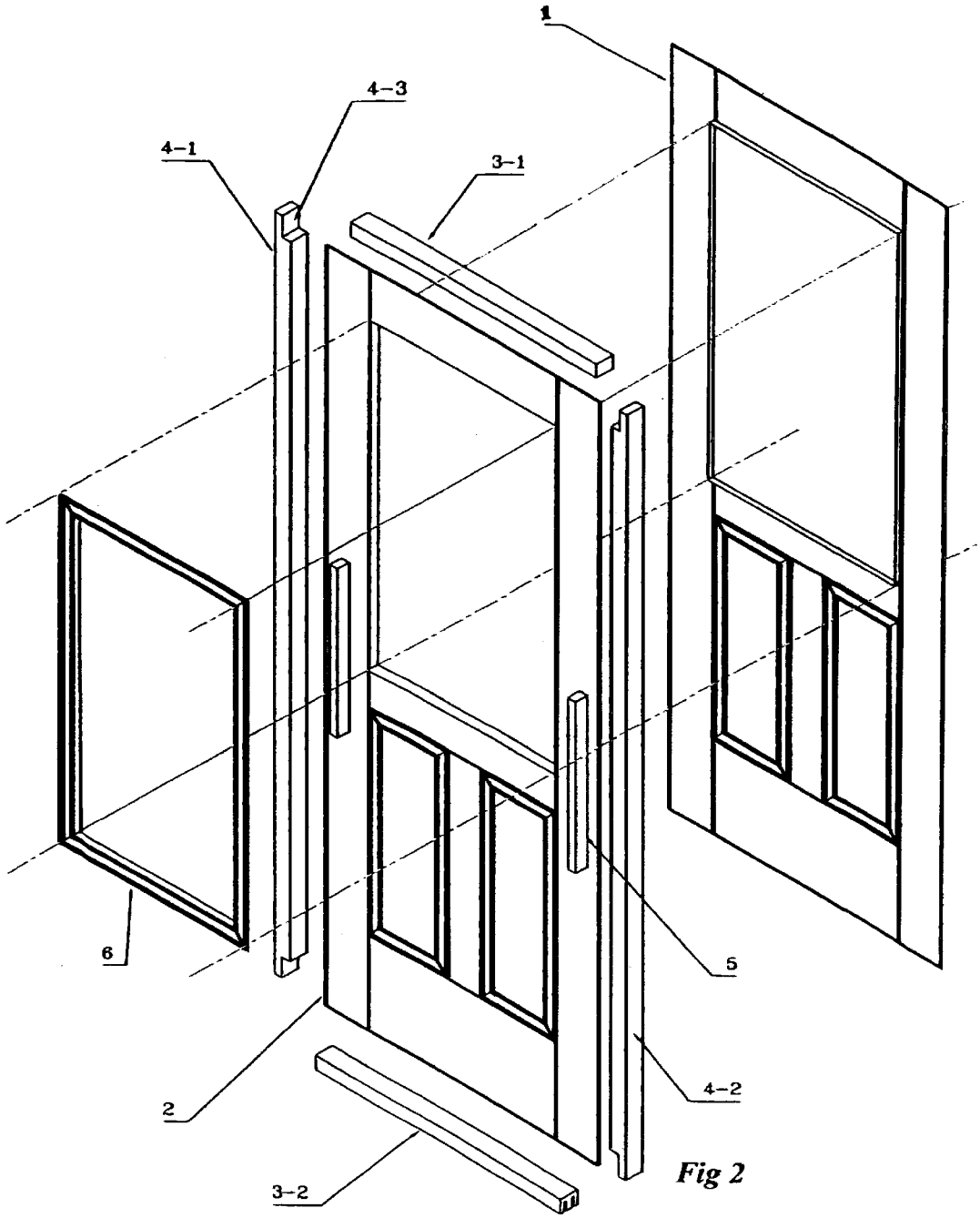
FIG. 2 is an exploded view of the door assembly structure of the present invention.
Figure 3:
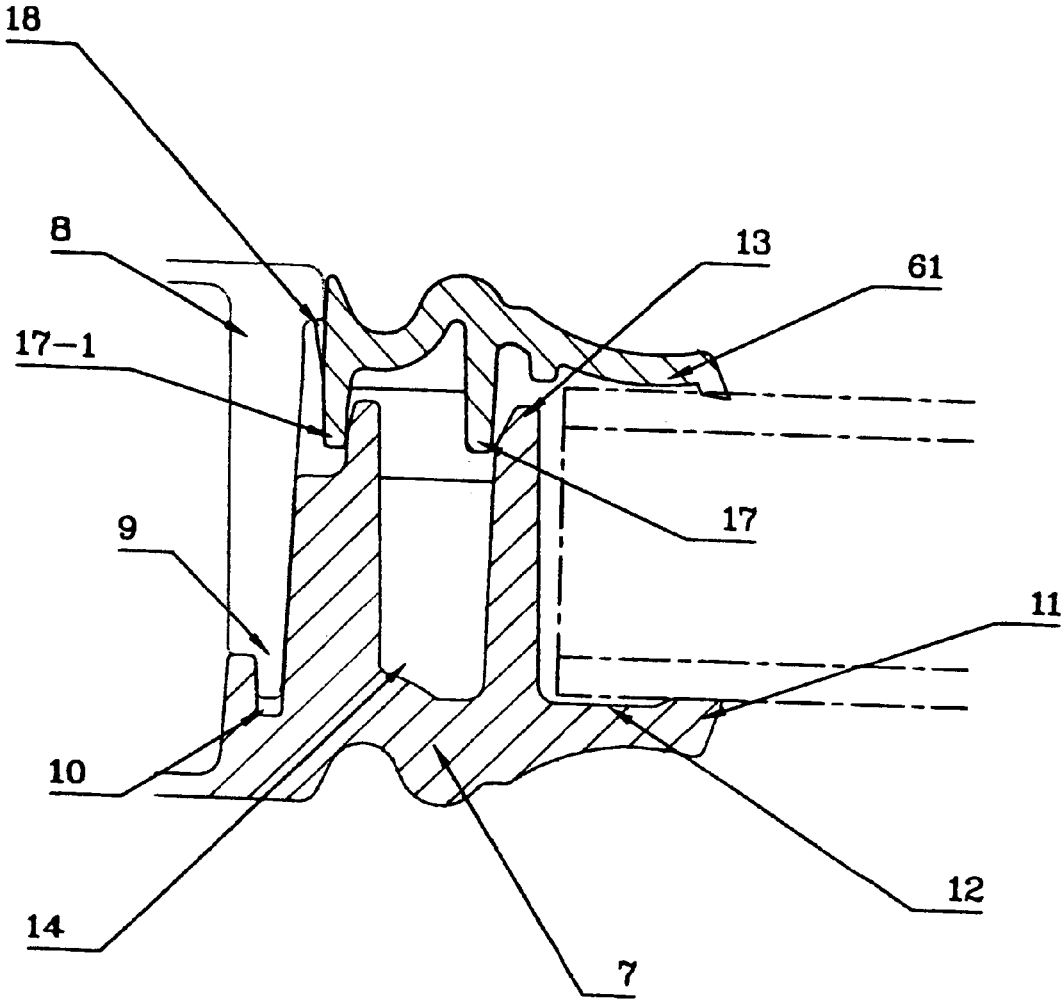
FIG. 3 is a door halving structure of the present invention.
Figure 4:
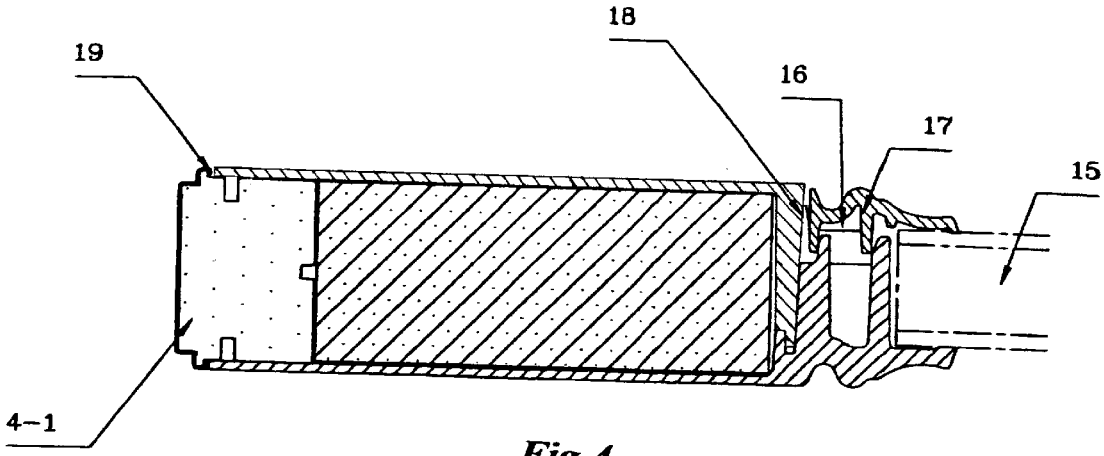
FIG. 4 is a transverse section drawing of FIG. 1 indicating the door leaf assembly structure of the present invention.
Figure 5:
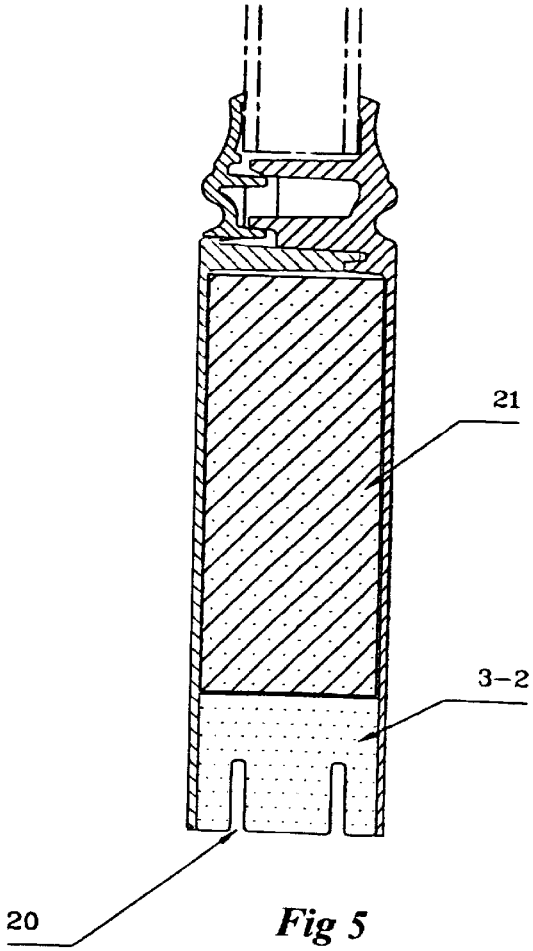
FIG. 5 is a vertical section drawing of FIG. 1 indicating the door leaf assembly structure of the present invention.
Figure 6:
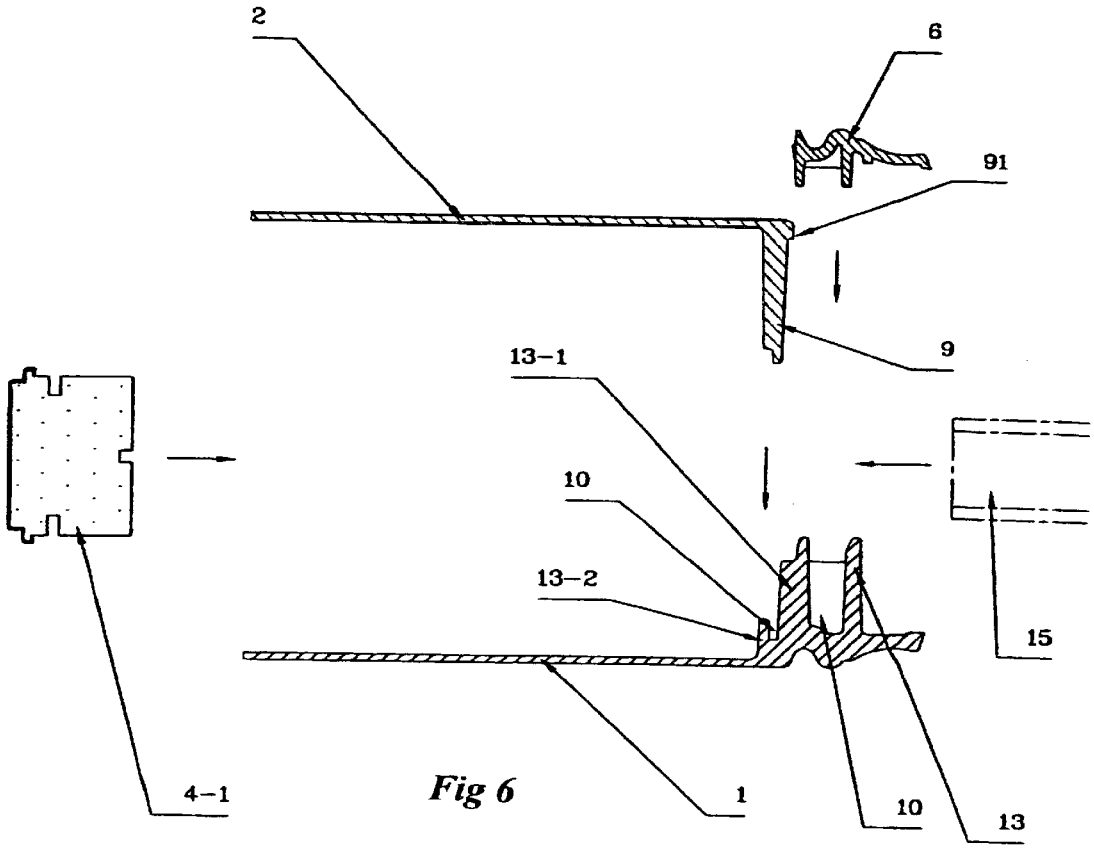
FIG. 6 is an explanatory drawing of the door leaf structure and the glass ejected-frame.
Figure 7:
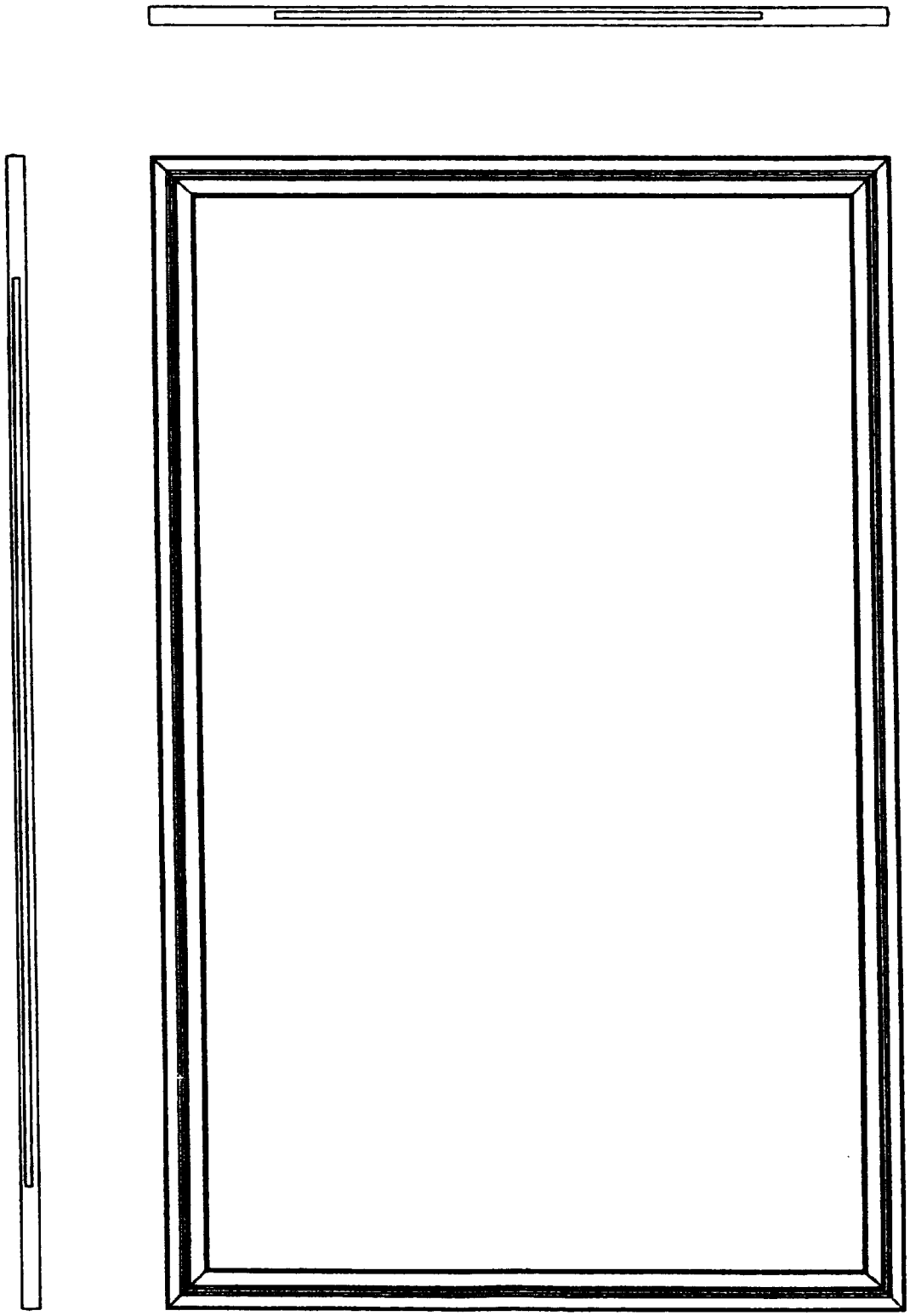
FIG. 7 is a three-view drawing of the glass ejected-frame.
Figure 8:
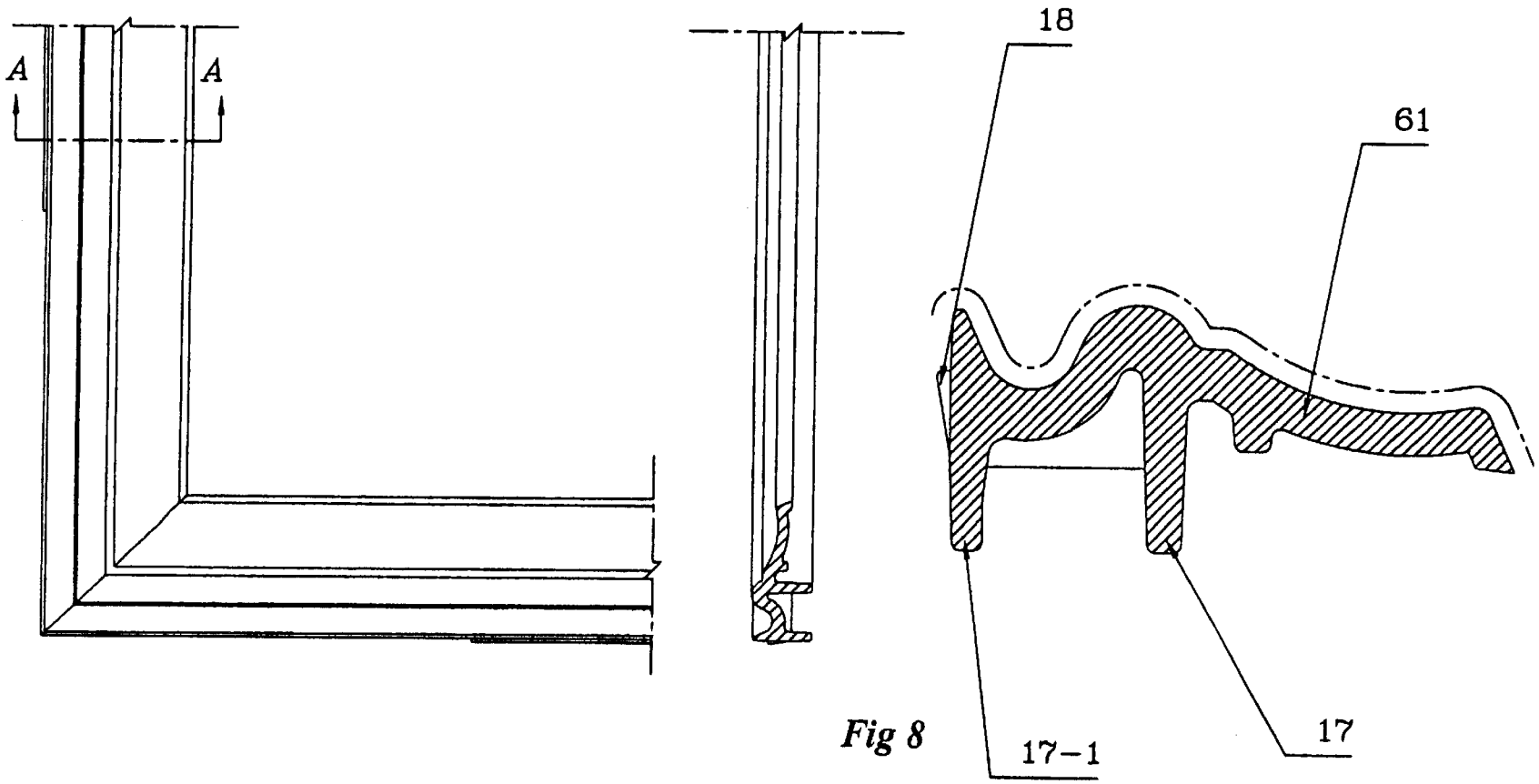
FIG. 8 is a section drawing of the glass ejected-frame.

The procedure of the assembly structure of hubbed door installed with glass is as follows (shown in FIG. 2):

First assemble the door skin 1 and 2, the top and the bottom lacing material 3, and the left and the right lacing material 4 with adhesive. Then, dispose a reinforcement member 5 at the handle position to enhance the mechanical strength of the handle while locked. The openings of the two skins halve and assemble each other (shown in FIG. 3). The adhesive can be used before halving in a practical example in order to increase its firmness. The left and the right lacing materials are position-bonded, by ribs, to the flush-sided door skin. The top and the bottom lacing materials are positioned through the milled notches 4-3 (refer to FIG. 1 and FIG. 2) at the top and the bottom ends of the left and the right lacing materials to form a closed cabin therebetween. The bottom lacing material is then drilled with a hole through which the ammonium polyester foaming plastic 21 is filled into the cabin to assemble the door (refer to FIG. 4 and FIG. 5). Then, the glass is laid in and fixed by the hold-down or the glass ejected-frame 6.

To refine the procedure, such as the necessity of processing by CNC center and of assembling the lacing material at the edges of opening, of the traditional hubbed door installed with glass, the present invention directly forms the edges of opening in one body during the manufacturing of the door skin and designs the edges of opening to be a halving structure to match the glass ejected-frame, to provide the following advantages:

1. Saving the cost of lacing material.
2. Decreasing the assembly labor by the halving assembly structure matching the glass ejected-frame.
3. Forming in one body to avoid the procedure of cutting the opening to decrease the production of waste and to obtain good watertight and airtight seals.
4. A reinforcement rib is designed at both the U shape structure and the glass ejected-frame structure to be strong enough to carry heavier load.
5. The dimension of glass opening is 22 inches by 36 inches, which is most commonly used.
6. The maximum width of the door is 35.75 inches which can vary depending on various needs.
7. The bottom lacing material used in the swing door and window has two grooves so as to install the soft airtight lacing material much easier.
8. The bottom lacing material used in the swing door and window can be drilled to install the roller.

What is claimed is:

1. A method of assembling a door, said method comprising:

integrally molding a first door leaf, having a substantially planar surface, to form:

(a) an opening for mounting the window, (b) edges of the opening that each form a U-shaped structure comprising two vertical ribs that extend substantially perpendicular to the planar surface, (c) a groove in a first side of the U-shaped structure of each edge, and (d) a horizontal rib in a second side, which is opposite the first side, of the U-shaped structure of each edge that is substantially parallel to the planar surface;

integrally molding a second door leaf, having a substantially planar surface, to form:

(e) an opening for mounting a window, (f) edges of the opening that each form an L-shaped structure with the planar surface, and (g) a rib on a distal end of each L-shaped structure;

interconnecting upper, lower, left, and right lacing materials to form a frame for the door assembly and an inner space within the frame;

mounting the substantially planar surfaces of the first and second door leafs on opposite sides of the frame;

aligning the first and second door leafs by abutting the L-shaped structure of each edge of the second door leaf opening against the U-shaped structure of a corresponding edge of the first door leaf opening, interconnecting the rib formed at the distal end of each L-shaped edge structure of the second door leaf opening with the groove of the corresponding edge of the first door leaf opening, for securing the alignment of the first and second door leafs, aligning the perimeter edges of the first and second door leafs to match the perimeter of the frame;

securing the first and second door leafs to the frame with adhesive;

supporting the window within the openings of the first and second door leafs with the horizontal rib of each edge of the first door leaf opening; and securing the window in the supported position by friction fitting an ejected window frame, on a side of the window opposing the side supported by the horizontal ribs, between each L-shaped structure and the vertical ribs of the corresponding U-shaped structure.

2. The method of claim 1, wherein the ejected window frame is made of wood, steel, polyvinyl chloride (PVC) extrude profile, PVC foam profile, PVC and wood scraps, polystyrene, polypropylene, or polypropylene and fiber glass.

3. The method of claim 1, further comprising at least partially filling the inner space within the frame with ammonium polyester foaming plastic.

4. A door assembly, comprising:

a window;

an ejected window frame;

a first door leaf, having a substantially planar surface, that is molded to integrally form an opening for mounting the window, wherein each edge of the first door leaf opening is integrally molded with the planar surface to form a U-shaped structure comprising two vertical ribs that extend substantially perpendicular to the planar surface, a groove is integrally molded into a first side of the U-shaped structure of each edge, and a horizontal rib is integrally molded with a second side, which is opposite the first side, of the U-shaped structure of each edge and is substantially parallel to the planar surface of the first door leaf; and a second door leaf, having a substantially planar surface, that is molded to integrally form an opening for mounting the window, wherein each edge of the second door leaf opening is integrally molded with the substantially planar surface to form an L-shaped structure with the planar surface, and a rib is integrally molded to a distal and of each L-shaped structure;

a frame comprising upper, lower, left, and right lacing materials that are interconnected to form the perimeter of the door assembly and an inner space within the frame, wherein:

the substantially planar surfaces of the first and second door leafs are attached to the frame opposite one another to enclose the space within the frame, the perimeter edges of the first and second door leafs match the perimeter of the frame, the L-shaped structure of each edge of the second door leaf opening abuts the U-shaped structure of a corresponding edge of the first door leaf opening to align the first and second door leafs, the rib formed at the distal end of each edge of the second door leaf opening interconnects with the groove of the corresponding edge of the first door leaf opening for securing the alignment of the first and second door leafs, and the window is held within the openings of the first and second door leafs by the horizontal rib of each edge of the first door leaf opening and the ejected window frame, which is friction fitted between each L-shaped structure and the vertical ribs of the corresponding U-shaped structure.

5. The door assembly of claim 4, wherein the ejected window frame is made of wood, steel, polyvinyl chloride (PVC) extrude profile, PVC foam profile, PVC and wood scraps, polystyrene, polypropylene, or polypropylene and fiber glass.

6. The door assembly of claim 4, further comprising ammonium polyester foaming plastic within the inner space within the frame.

* * * * *